United States Patent [19]

Iiyama et al.

[11] Patent Number: 4,788,959

[45] Date of Patent: Dec. 6, 1988

[54] FUEL INJECTION PUMP

[75] Inventors: Akihiro Iiyama; Toshifumi Nishimura, both of Yokosuka, Japan

[73] Assignee: Nissan Motor Company, Limited, Kanagawa, Japan

[21] Appl. No.: 794,850

[22] Filed: Nov. 4, 1985

[30] Foreign Application Priority Data

Nov. 6, 1984 [JP] Japan ..... 59-233838

[51] Int. Cl.[4] ..... E02M 39/00

[52] U.S. Cl. ..... 123/503; 123/449; 123/496

[58] Field of Search ..... 123/503, 449, 506, 496, 123/495

[56] References Cited

U.S. PATENT DOCUMENTS

| | | | |
|---|---|---|---|
| 3,614,944 | 10/1971 | Ulbing | 123/496 |
| 3,758,241 | 9/1973 | Eheim | 123/449 |
| 3,908,619 | 9/1985 | Bittelmeyer | 123/503 |
| 4,476,835 | 10/1984 | Laufer | 123/503 |

FOREIGN PATENT DOCUMENTS

| | | | |
|---|---|---|---|
| 2814758 | 10/1979 | Fed. Rep. of Germany | 123/503 |
| 3329384 | 2/1985 | Fed. Rep. of Germany | 123/449 |
| 3336869 | 4/1985 | Fed. Rep. of Germany | 123/449 |
| 0188763 | 11/1982 | Japan | 123/496 |
| 371685 | 4/1932 | United Kingdom | 123/503 |
| 954493 | 4/1964 | United Kingdom | 123/501 |

*Primary Examiner*—Carl Stuart Miller

*Attorney, Agent, or Firm*—Lowe, Price, LeBlanc, Becker & Shur

[57] ABSTRACT

First and second cam members are engageable in a fuel injection pump. A first device urges the first cam member toward the second cam member to obtain engagement between them. The first cam member reciprocates as it moves relative to the second cam member when the first and second cam members are in engagement. A plunger connected to the first cam member reciprocates with the first cam member. The plunger defines at least part of a pumping chamber which contracts and expands as the plunger reciprocates. As the pumping chamber expands in a fuel intake stroke, fuel moves into the pumping chamber. As the pumping chamber contracts in a fuel compression stroke, the fuel moves out of the pumping chamber. A second device resists movement of the plunger in the fuel compression stroke.

14 Claims, 4 Drawing Sheets

10
11
12
13
14
15
16
17
18
19
20
21
22
23
24
25
26
27
28
29
30
31
32
33
34
35
36
37
38
39
45
L
II
II

FUEL INJECTION PUMP

BACKGROUND OF THE INVENTION

This invention relates to a fuel injection pump for an internal combustion engine, such as a diesel engine.

In diesel engines, a fuel injection pump periodically supplies fuel to cylinders or combustion chambers. As the fuel injection pressure rises, the injected fuel is atomized better and the engine performance is enhanced.

Some distribution-type fuel injection pumps have a plunger which is driven to reciprocate synchronously with the engine crankshaft rotation by means of a cam mechanism. The end face of the plunger defines in part a pumping chamber. As the plunger moves in one direction, the pumping chamber contracts and thus fuel is driven out of the pumping chamber and is injected into the engine cylinder. As the plunger moves in the opposite direction, the pumping chamber expands and thus fuel is drawn into the pumping chamber.

The cam mechanism includes rollers and cam protrusions urged into engagement with the rollers by a cam spring. The cam protrusions are fixed to the plunger. As the engine crankshaft rotates, the cam protrusions move relative to the rollers, reciprocating the plunger.

The profile of the cam protrusions is generally designed such that the acceleration of the plunger changes in direction near the center of the fuel injection stroke. As a result of this change of the acceleration direction, the considerable inertia of the cam protrusions and the plunger acts against the force of the cam spring in the latter half of the fuel injection stroke. If the inertia overcomes the spring force, the cam protrusions move out of engagement with the rollers, impairing the fuel injection characteristics. Accordingly, the force of the cam spring is chosen to be adequate to hold the cam protrusions in constant engagement with the rollers.

The fuel injection pressure is proportional to the height or lift of the cam protrusions. If the lift of the cam protrusions is set to be great in order to achieve a high fuel injection pressure, a strong cam spring is necessary to hold the rollers and the cam protrusions in continuous contact. In this case, the cam protrusions are periodically pressed against the rollers by strong forces so that their service lives are shortened. Furthermore, a correspondinly larger torque to is required to drive the cam mechanism.

SUMMARY OF THE INVENTION

It is an object of this invention to provide a fuel injection pump which produces a high fuel injection pressure while maintaining adequate durability.

In accordance with this invention, first and second cam members are engageable in a fuel injection pump. An urging device urges the first cam member toward the second cam member to engage the first and second cam members. The first cam member reciprocates as it moves relative to the second cam member in cases where the first and second cam members are in engagement. The urging device acts against the first cam member when the first cam member moves in a first direction. A fuel pumping plunger connected to the first cam member reciprocates with the first cam member. An assisting device assists the urging device when the first cam member moves in said first direction.

BRIEF DESCRIPTION OF THE DRAWINGS

Like and corresponding elements are denoted by the same reference numerals throughout the drawings.

DESCRIPTION OF THE FIRST PREFFERED EMBODIMENT

Figures 1, 2:
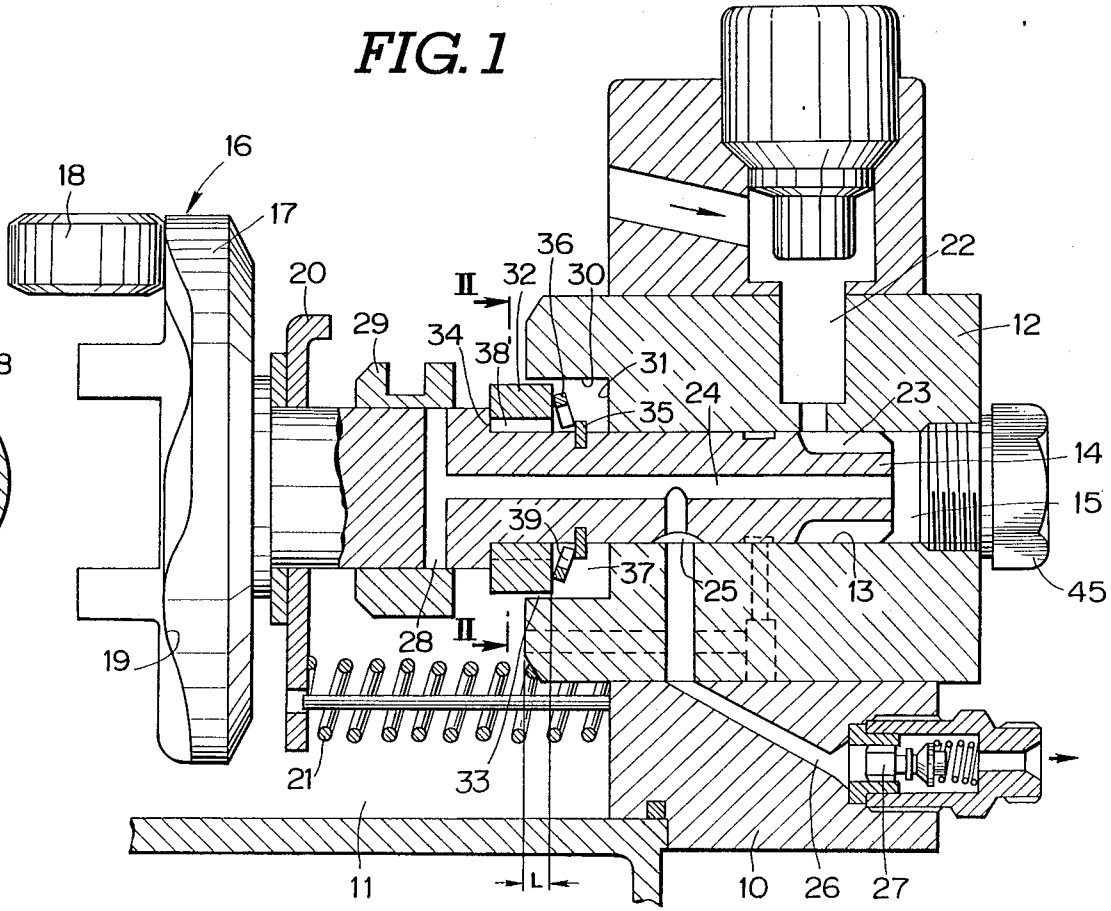
FIG. 1 is a longitudinal section view of part of a fuel injection pump according to a first embodiment of this invention.
FIG. 2 is a cross-section through the plunger and the piston taken along the line II—II of FIG. 1.

With reference to FIG. 1, a fuel injection pump has a housing 10 enclosing a fuel reservoir 11 to which fuel is supplied by means of a fuel feed pump (not shown). A barrel 12 fixed to the housing 10 has a cylindrical bore 13 into which a cylindrical plunger 14 slidably extends. A plug 45 bolted to the barrel 12 closes the end of the bore 13. The barrel 12 and the plunger 14 define a pumping or high-pressure chamber 15 at the closed end of the blind bore 13. As the plunger 14 moves axially toward and away from the pumping chamber 15, the pumping chamber 15 contracts and expands respectively.

The plunger 14 is connected to the crankshaft of an engine (not shown) via a drive train designed such that the plunger 14 rotates circumferentially at half the speed of rotation of the engine crankshaft and that the plunger 14 reciprocates axially a number of times equal to the number of the engine combustion chambers for each full double-rotation of the engine crankshaft.

The drive train includes a cam mechanism 16 having a cam disc 17 and cam rollers 18, only one of the latter of which is shown. The cam disc 17 is coupled to the engine crankshaft in such a manner that the disc 17 can move axially and rotate at half the rotational speed of the engine crankshaft. The end of the plunger 14 remote from the pumping chamber 15 is coaxially fixed to the cam disc 17 so that the plunger 14 moves together with the cam disc 17. The face of the cam disc 17 remote from the pumping chamber 15 has circumferentially spaced cam protrusions 19, the number of which is equal to the number of the engine combustion chambers. It should be noted that the number of the cam rollers 18 is generally equal to the number of the cam protrusions 19. The cam rollers 18 oppose the cam face of the disc 17. A spring seat 20 is fixedly mounted on the end of the plunger 14 near the cam disc 17. A spring 21 seated between the inner surface of the housing 10 and the seat 20 urges the cam disc 17 toward the cam rollers 18 so that the cam face of the disc 17 remains in constant contact with the cam rollers 18. The cam rollers 18 are rotatably held by a retainer (not shown) supported on the housing 10. The cam rollers 18 are stationary axially with respect to the cam disc 17. As the cam disc 17 rotates, the cam rollers 18 periodically ascend and descend the cam protrusions 19, reciprocating the cam disc 17 and the plunger 14 axially.

The walls of the housing 10 and the barrel 12 define a fuel intake passage 22 extending from the reservoir 11 and opening onto the inner circumferential surface of the barrel 12. The end of the plunger 14 near the pumping chamber 15 has angularly separated fuel intake grooves 23 leading to the pumping chamber 15. As the plunger 14 rotates, the fuel intake passage 22 moves into and out of communication with each of the fuel intake grooves 23 sequentially. While the plunger 14 moves axially in the direction of expanding the pumping chamber 15, the fuel intake passage 22 remains in communication with one of the fuel intake grooves 23 so that fuel is driven from the reservoir 11 to the pumping chamber 15 via the passage 22 and the groove 23. This constitutes a fuel intake stroke. While the plunger 14 moves axially in the direction of contracting the pumping chamber 15, all of the fuel intake grooves 23 remain out of communication with the fuel intake passage 22.

The plunger 14 has an axial fuel passage 24 extending from the pumping chamber 15, and a fuel distribution port 25 extending radially from the axial passage 24 and opening onto the circumferential surface of the plunger 14. The walls of the housing 10 and the barrel 12 define fuel delivery passages 26 extending from the inner circumferential surface of the barrel 12 to the outer surface of the housing 10. The number of the fuel delivery passages 26 is equal to the number of the engine combustion chambers. It should be noted that only one of the fuel delivery passages 26 is shown. The fuel delivery passages 26 lead to fuel injection nozzles (not shown) via fuel delivery valves 27 respectively. The inner ends of the fuel delivery passages 26 are spaced angularly. As the plunger 14 rotates, the fuel distribution port 25 moves into and out of communication with each of the fuel delivery passages 26 sequentially. While the plunger 14 moves axially in the direction of contracting the pumping chamber 15, that is, while the plunger 14 moves in a fuel compression stroke, the fuel distribution port 25 remains in communication with one of the fuel delivery passages 26 so that fuel can be driven from the pumping chamber 15 toward the fuel injection nozzle via the passages 24, 25, and 26, and the fuel delivery valve 27. This constitutes a fuel injection stroke, since the fuel supplied to the fuel injection nozzle is discharged into the engine combustion chamber. While the plunger 14 moves in the direction of expanding the pumping chamber 15, the fuel distribution port 25 generally remains out of communication with all of the fuel delivery passages 26.

A fuel relief port 28 communicating with the axial fuel passage 24 extends diametrically through the section of the plunger 14 residing within the reservoir 11. A control sleeve 29 residing within the reservoir 11 is concentrically and slidably mounted on the plunger 14. As the plunger 14 reciprocates axially, the ends of the fuel relief port 28 are periodically blocked and uncovered by the control sleeve 29. During each fuel compression stroke of the plunger 14, the fuel relief port 28 is first blocked by the control sleeve 29 and is then uncovered by the control sleeve 29. While the fuel relief port 28 remains blocked by the control sleeve 29, all of the fuel forced out of the pumping chamber 15 is directed toward the fuel delivery passage 26 via the fuel passages 24 and 25 so that fuel injection is enabled. When the fuel relief port 28 is uncovered by the control sleeve 29 and is thus exposed to the reservoir 11, all of the fuel forced out of the pumping chamber 15 is directed toward the reservoir 11 via the fuel passages 24 and 28 without entering the fuel delivery passage 26 so that fuel injection is disabled. Since the axial position of the control sleeve 29 determines the timing in units of the angle of the engine crankshaft at which fuel injection is disabled, the length of the effective fuel injection stroke, that is, the fuel injection quantity depends on the axial position of the control sleeve 29.

The control sleeve 29 is generally linked to an accelerator pedal (not shown) so that the axial position of the control sleeve 29 is adjusted in accordance with the power output required of the engine. The control sleeve 29 is also connected to an engine speed governor (not shown) so that the axial position of the control sleeve 29 is adjusted in accordance with the engine rotational speed.

The cam rollers 18 can move circumferentially with respect to the cam disc 17. Fuel injection timing in units of the angle of the engine crankshaft depends on this circumferential position of the cam rollers 18 relative to the cam disc 17. A timing adjustment device (not shown) controls the circumferential position of the cam rollers 18 in accordance with the engine rotational speed.

The end of the barrel 12 projecting into the reservoir 11 has a bore 30 coaxial with the bore 13. The diameter of the bore 30 is greater than the diameter of the bore 13. The greater bore 30 extends from the reservoir 11 and terminates at a radially-extending annular shoulder 31 onto which the smaller bore 13 opens. The plunger 14 extends coaxially through the greater bore 30.

A sleeve piston 32 is coaxially and slidably mounted on the section of the plunger 14 at and near the entrance of the greater bore 30 in the situation of FIG. 1. It should be noted that the plunger 14 moves axially. The outside diameter of the piston 32 is smaller than the inside diameter of the bore 30 so that the piston 32 is separated radially from the inner walls of the barrel 12 by a small annular clearance 33 in the situation of FIG. 1. The section of the plunger 14 opposing the reservoir 11 has an annular shoulder 34. A snap ring 35 is fixed to the section of the plunger 14 within the bore 30 in the situation of FIG. 1. A coned disc spring 36 seated between the snap ring 35 and the end face of the piston 32 urges the piston 32 toward the shoulder 34. The other end face of the piston 32 normally abuts the shoulder 34. As will be described hereinafter, the piston 32 separates from the shoulder 34 against the force of the spring 36 under certain conditions.

The piston 32 moves into and out of the bore 30 as the plunger 14 reciprocates axially. The piston 32, the barrel 12, and the plunger 14 define a fluid chamber 37, which resides within the bore 30 when the piston 32 moves into the bore 30 as shown in FIG. 1. Even when the piston 32 moves into the bore 30, the fluid chamber 37 remains in communication with the reservoir 11 via the clearance 33 between the piston 32 and the barrel 12. The fluid chamber 37 is filled with fuel supplied from the reservoir 11.

As shown in FIGS. 1 and 2, the inner circumferential surface of the piston 32 has axial grooves 38 extending between the ends of the piston 32. The grooves 38 extend cicumferentially within angularly-separated preset ranges. The inner circumferential surface of the spring 36 has axial grooves 39 extending between the ends of the spring 36. The grooves 38 of the piston 32 communicate with the fluid chamber 37 via the grooves 39 of the spring 36. When the piston 32 rests on the shoulder 34 as shown in FIG. 1, the grooves 38 of the piston 32 are blocked by the shoulder 34. When the piston 32 separates from the shoulder 34, the grooves 38 of the piston 32 are unblocked so that the grooves 38 of the piston 32 and the grooves 39 of the spring 36 connect the fluid chamber 37 to the reservoir 11.

It should be noted that FIG. 1 shows a situation in which the plunger 14 reaches the maximally lifted position, that is, the right-hand limit position. In this situation, the piston 32 axially extends into bore 30 by the length L. This length L is chosen to be smaller than the entire axial stroke of the plunger 14 so that the piston 32 moves out of the bore 30 in the fuel intake stroke and that the piston 32 enters the bore 30 during the segment of the fuel compression stroke after the initiation of fuel injection.

Figure 3:
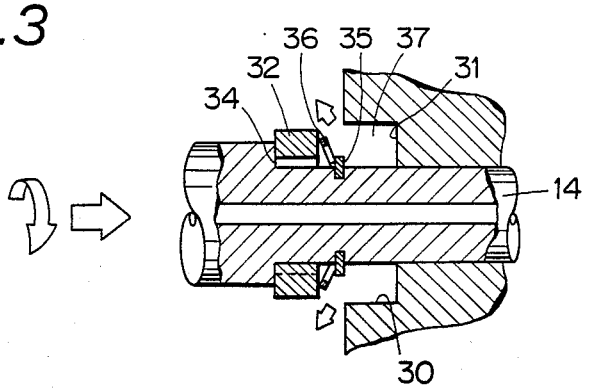
FIG. 3 is a longitudinal section view of segments of the plunger, the barrel, the piston, and associated elements at the initiation of the fuel compression stroke in the fuel injection pump of FIG. 1.

FIG. 3 shows the plunger 14 in an initial stage of the fuel compression stroke. In this situation, the piston 32 lies outside of the bore 30 by a considerable interval so that the fluid chamber 37 communicates with the reservoir 11 via a relatively large flow path. Accordingly, the pressure in the fluid chamber 37 is essentially the same as the pressure in the reservoir 11 so that the fluid, that is, the fuel within the fluid chamber 37 essentially does not resist the movement or lift of the plunger 14. Furthermore, in this initial stage of the fuel compression stroke, the piston 32 remains in contact with the shoulder 34.

Figure 4:
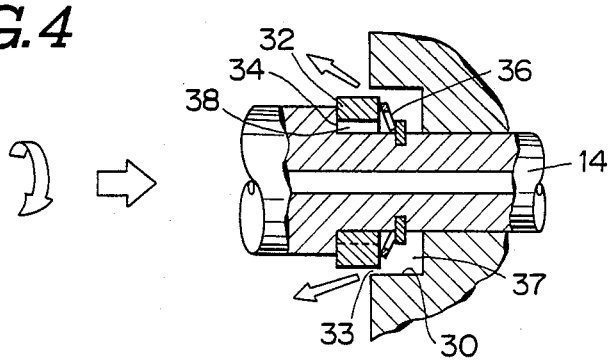
FIG. 4 is a view similar to FIG. 3 and illustrates the parts when the inventive resistance to the fuel compression stroke becomes effective.

As the fuel compression stroke advances, the piston 32 moves into the bore 30 as shown in FIG. 4. In this situation, the fluid chamber 37 communicates with the reservoir 11 only via the small clearance 33 between the piston 32 and the barrel 12 so that the escape of fuel from the fluid chamber 37 to the reservoir 11 is limited to a small rate and thus the pressure in the fluid chamber 37 becomes considerably higher than the pressure in the reservoir 11. This pressure increase resists the movement or lift of the plunger 14. The resistance to the lift of the plunger 14 helps the cam spring 21 (see FIG. 1) maintain engagement between the cam disc 17 and the cam rollers 18 as will be made clear hereinafter. It should be noted that the piston 32 remains in contact with the shoulder 34 during the fuel compression stroke.

Figure 5:
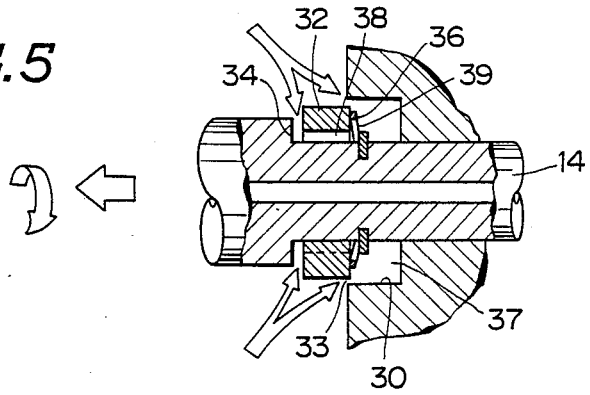
FIG. 5 is a view similar to FIG. 3 and illustrates the parts in the fuel intake stroke.

After the plunger 14 reaches the point of maximal lift, the plunger 14 reverses axially and initiates the fuel intake stroke. Upon initiation of the fuel intake stroke, the fluid chamber 37 expands but the rate of fuel flow from the reservoir 11 into the fluid chamber 37 is relatively small, since only the small clearance 33 connects the fluid chamber 37 and the reservoir 11. Accordingly, the pressure in the fluid chamber 37 drops considerably. This pressure drop and also the inertia of the piston 32 cause the piston 32 to separate from the shoulder 34 against the force of the spring 36 as shown in FIG. 5. Thus, the resulting gap between the piston 32 and the shoulder 34, the grooves 38 of the piston 32, and the grooves 39 of the spring 36 connect the fluid chamber 37 to the reservoir 11 and thereby allow a great rate of fuel flow from the reservoir 11 to the fluid chamber 37, increasing the pressure in the fluid chamber 37 to a level comparable to the pressure in the reservoir 11. In this way, the drop in the pressure in the fluid chamber 37 is momentary and this pressure substantially remains comparable to the pressure in the reservoir 11 during the fuel intake stroke. Accordingly, the pressure in the fluid chamber 37 essentially does not resist the movement of the plunger 14 in the fuel intake stroke. This ensures that the cam spring 21 (see FIG. 1) keeps the cam disc 17 in contact with the cam rollers 18 as will be made clear hereinafter. Furthermore, the great rate of fuel flow into the fluid chamber 37 during the fuel intake stroke reliably prevents the occurrence of cavitation in the fluid chamber 37.

Figure 6:
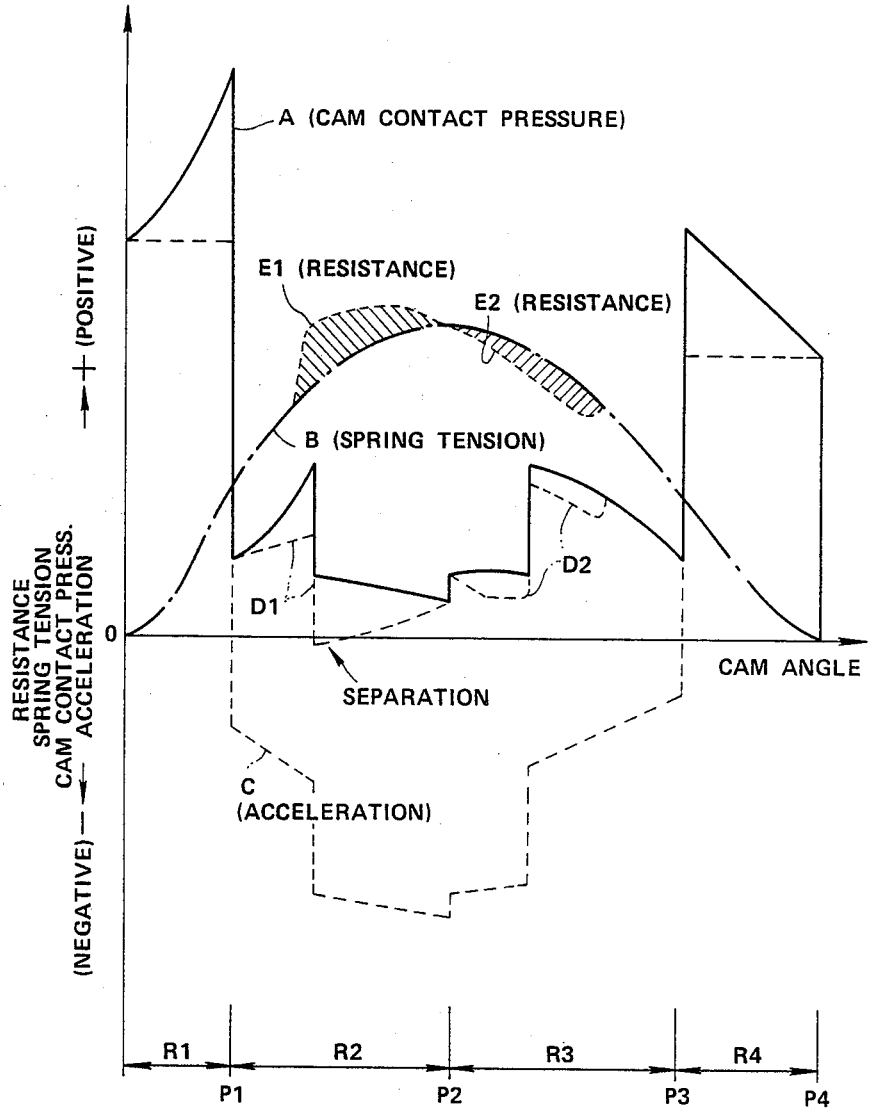
FIG. 6 is a graph of the acceleration of cam lift, the tension of the spring, the cam contact pressure, and the resistance to the cam movement which are all plotted as functions of the angle of the cam in the fuel injection pump of FIG. 1.

In FIG. 6, the solid curve A represents the load or pressure transmitted by the contact between the cam protrusions 19 and the cam rollers 18. The dot-dash curve B represents the compression force exerted by the spring 21. The full dash curve C represents the acceleration of cam lift, that is, the axial acceleration of the plunger 14. The direction of this acceleration toward the pumping chamber 15 is defined to be positive. Each of these parameters is plotted as a function of the angular position of the cam ring 17 relative to the cam rollers 16.

As shown in FIG. 6, during the first stage of the fuel compression stroke represented by the range R1, the acceleration C remains at high positive values and the compressed fuel reacts against the cam lift so that the cam contact pressure A increases at a high rate starting from a large value. At the point P1 of cam rotation, that is, at the end of the range R1, the rollers 16 pass inflection points of the profiles of the cam protrusions 19 so that the acceleration C changes to a negative value. In accordance with this change in the direction of acceleration C, the cam contact pressure A decreases abruptly to a low positive value. During the rest of the fuel compression stroke represented by the range R2, the cam contact pressure A remains at low positive values.

In conventional fuel injection pumps, if the maximum cam lift were set relatively large in order to achieve a high fuel injection pressure, the cam contact pressure might drop below zero in a segment of the range R2 as shown by the broken curve D1 so that the cam disc would hop or separate briefly from the cam rollers.

In this embodiment, the timing at which the piston 32 moves into the bore 30, that is, the timing at which the fuel in the fluid chamber 37 commences effectively resisting the lift of the plunger 14 and the cam disc 17 is chosen to immediately precede the timing in the drop of the cam contact pressure which might result in separation of the cam disc 17 from the cam rollers 18. As shown by the broken curve E1, this resistance force acts on the cam disc 17 in the same direction as the compression spring force B, reliably maintaining the cam contact pressure in an acceptable positive range and thereby preventing separation of the cam disc 17 from the cam rollers 18.

The plunger 14 moves from the fuel compression stroke into the fuel intake stroke at cam angle P2 at which each cam roller 18 passes the peak of the corresponding cam protrusion 19. In the first stage of the fuel intake stroke represented by the range R3, the acceleration C still remains negative. If the resistance continued to act on the plunger 14 and the cam disc 17 as shown by the broken curve E2, the cam contact pressure would adversely decrease toward a negative value as shown by the broken curves D2. In this embodiment, the resistance to movement of the plunger 14 is relieved in the fuel intake stroke as described previously so that the cam contact pressure A is maintained at acceptably positive values. Accordingly, the engagement between the cam disc 17 and the cam rollers 18 is reliably maintained in the fuel intake stroke as well.

At the end of the range R3, that is, at cam angle P3, the cam rollers 18 pass inflection points of the profiles of the cam protrusions 19 so that the acceleration C changes to a high positive value and the cam contact pressure A also increases to a high value. After the point P3, the plunger 14 moves into the latter part of the fuel intake stroke represented by the range R4. During this range R4, the acceleration C remains at high positive values and the cam contact pressure A also remains at high positive values.

It should be noted that the characteristics of the resistance to movement of the plunger 14 depends on the effective cross-sectional area of the clearance 33 and also on the axial length of the piston 32. These characteristics are predetermined appropriately in accordance with required performances of the fuel injection pump, the profile of each cam protrusion 19, and the required maximum speed of the fuel injection pump.

DESCRIPTION OF THE SECOND PREFERRED EMBODIMENT

Figure 7:
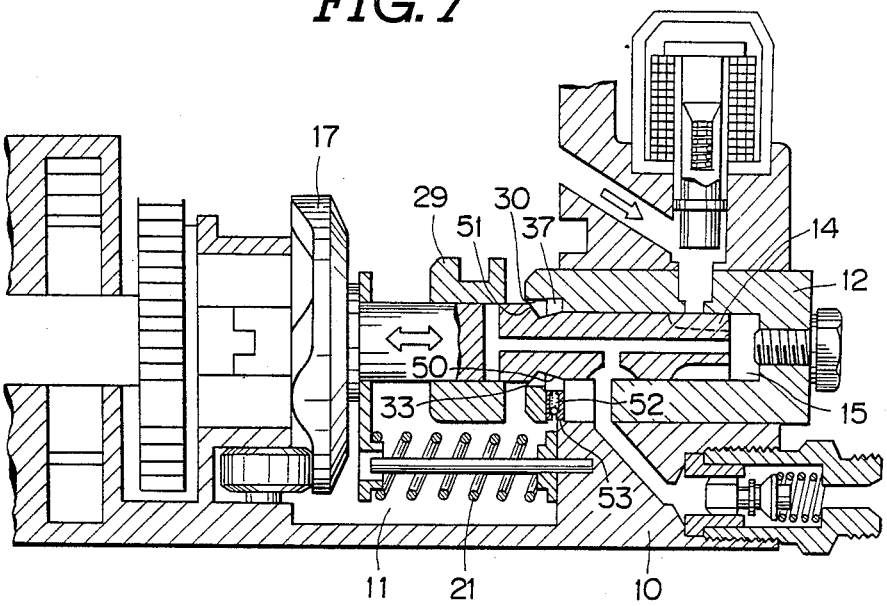
FIG. 7 is a longitudinal section view of part of a fuel injection pump according to a second embodiment of this invention.

FIG. 7 shows the second embodiment of this invention which is similar to the embodiment of FIGS. 1 to 6 except for the design changes mentioned below.

The piston 32, the snap ring 35, and the coned disc spring 36 are omitted from this embodiment.

The plunger 14 has an annular recess 50, the edge of which remote from the pumping chamber 15 is defined by a tapered shoulder 51 movable into and out of the bore 30. The segment of the plunger 14 forming the recess 50 and the segment of the barrel 12 forming the bore 30 define the fluid chamber 37. The segment of the plunger 14 extending from the recess 50 toward the cam disc 17 is of smaller diameter than the inside diameter of the bore 30 so that the clearance 33 is formed between the elements 14 and 12 when the tapered shoulder 51 moves into the bore 30. This clearance 33 maintains communication between the fluid chamber 37 and the reservoir 11.

The barrel 12 has a radial fluid passage 52 connecting the fluid chamber 37 and the reservoir 11. A check valve 53 diposed in the fluid passage 52 allows the flow of fluid, that is, the flow of fuel, only in the direction from the reservoir 11 to the fluid chamber 37.

At the initiation of the fuel compression stroke, the shoulder 51 resides outside the bore 30 so that the fluid chamber 37 communicates with the reservoir 11 via a large path which allows essentially free escape of fuel from the fluid chamber 37. Accordingly, the fuel in the fluid chamber 37 substantially does not resist movement of the plunger 14 and the cam disc 17.

As the fuel compression stroke advances, the tapered shoulder 51 moves into the bore 37 so that only the small clearance 33 connects the fluid chamber 37 to the reservoir 11. Accordingly, escape of fuel from the fluid chamber 37 is limited to a small rate so that the fuel in the fluid chamber 37 effectively resists movement of the plunger 14 and the cam disc 17. It should be noted that the check valve 53 keeps the fluid passage 52 blocked during the fuel compression stroke.

When the fuel intake stroke is initiated, the check valve 53 unblocks the fluid passage 52, allowing a high rate of fuel flow from the reservoir 11 into the fluid chamber 37. As a result, the additional resistance to movement of the plunger 14 and the cam disc 17 remains relieved during the fuel intake stroke.

DESCRIPTION OF THE THIRD PREFERRED EMBODIMENT

Figure 8:
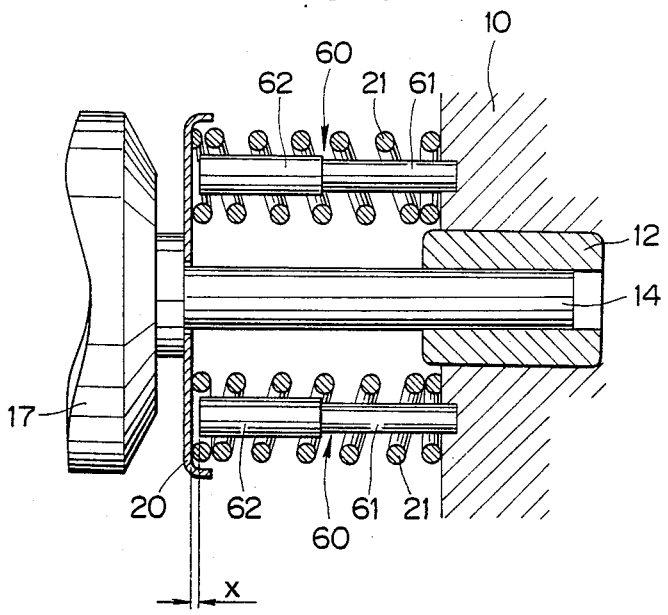
FIG. 8 is a longitudinal section view of part of a fuel injection pump according to a third embodiment of this invention.

FIG. 8 shows the third embodiment of this invention which is similar to the embodiment of FIGS. 1 to 6 except for the following design changes.

The piston 32, the snap ring 35, the coned disc spring 36, and the bore 30 are omitted from this embodiment.

Spiral springs 21 seated between the seat 20 and the inner surface of the housing 10 urge the cam disc 17 into engagement with the cam rollers 18 (see FIG. 1). Cylindrical dampers 60 extend inside the spiral springs 21 along the central straight axes of the spiral springs 21 which lie parallel to the axis of the plunger 14. Each of the dampers 60 has a base 61 fixed to the housing 10, and an operating body 62 fitted over the base 61 and movable relative to the base 61. As the operating body 62 moves relative to the base 61, a fluid chamber (not shown) within each damper 60 contracts and expands. Movement of the operating body 62 causes axial contraction and expansion of the damper 60. When the cam lift is zero, the free end of the operating body 62 of each damper 60 is separated from the spring seat 20 by a distance X.

When the plunger 14 and the cam disc 17 are lifted by the distance X in the fuel compression stroke, the dampers 60 come into contact with the spring seat 20. As the plunger 14 and the cam disc 17 are lifted by more than the distance X in the fuel compression stroke, the dampers 60 remain in contact with the spring seat 20 and continue to contract, thereby resisting movement of the elements 14 and 17.

During the fuel intake stroke, the dampers 60 expand due to the forces of internal return springs (not shown) at rates smaller than the speed of the spring seat 20 so that the dampers 60 remain out of contact with the spring seat 20. Accordingly, the dampers 60 do not resist movement of the plunger 14 and the cam disc 17 in the fuel intake stroke.

What is claimed is:

1. A fuel injection pump comprising:

(a) engageable first and second cam members, the first cam member reciprocating axially as the first cam member moves angularly relative to the second cam member when the first and second cam members are in engagement;

(b) means for urging the first cam member toward the second cam member to engage the first and second cam members;

(c) a plunger connected to the first cam member for reciprocation with the first cam member, the plunger defining at least a part of a pumping chamber, the pumping chamber contracting and expanding as the plunger reciprocates;

(d) means for allowing fuel to move into the pumping chamber as the pumping chamber expands in a fuel intake stroke;

(e) means for allowing the fuel to move out of the pumping chamber as the pumping chamber contracts in a fuel compression stroke; and (f) means for resisting movement of the plunger in at least part of the fuel compression stroke and relieving resistance to movement of the plunger in the fuel intake stroke wherein the resisting means comprises a piston slidably mounted on the plunger, a spring urging the piston to seat the piston on a shoulder on the plunger so that the piston reciprocates as the plunger reciprocates, wherein the piston is seated on the shoulder in the fuel compression stroke and separates from the shoulder against the the force of the spring in the fuel intake stroke, a second fluid chamber at least partially defined by the piston, the second fluid chamber contracting and expanding as the piston reciprocates, a reservoir filled with fuel, a first passage connecting the second fluid chamber to the reservoir, and a second passage extending from the second fluid chamber through the piston, the second passage being disconnected from the reservoir when the piston is seated on the shoulder and being connected to the reservoir when the piston separates from the shoulder.

2. A fuel injection pump comprising:

(a) engageable first and second cam members, the first cam member reciprocating axially as the first cam member moves angularly relative to the second cam member when the first and second cam members are in engagement;

(b) means for urging the first cam member toward the second cam member to engage the first and second cam members;

(c) a plunger connected to the first cam member for reciprocation with the first cam member, the plunger defining at least part of a pumping chamber, the pumping chamber contracting and expanding as the plunger reciprocates;

(d) means for allowing fuel to move into the pumping chamber as the pumping chamber expands in a fuel intake stroke;

(e) means for allowing the fuel to move out of the pumping chamber as the pumping chamber contracts in a fuel compression stroke; and (f) means for resisting mevement of the plunger in at least part of the fuel compression stroke and relieving resistance to movement of the plunger in the fuel intake stroke wherein the resisting means comprises a second fluid chamber expanding in the fuel intake stroke and contracting in the fuel compression stroke, a reservoir filled with fuel, a first passage connecting the second fluid chamber to the reservoir, a seoncd passage connecting the second fluid chamber to the reservoir, and valve means for blocking the second passage in the fuel compression stroke and unblocking the second passage to permit unblocked fuel flow from the fuel reservoir to the second fluid chamber during the fuel intake stroke.

3. A fuel injection pump comprising:

(a) engageable first and second cam members, the first cam member reciprocating axially as the first cam member moves angularly relative to the second cam member when the first and second cam members are in engagement;

(b) means for urging the first cam member toward the second cam member to engage the first and second cam members;

(c) a plunger connected to the first cam member for reciprocation with the first cam member, the plunger defining at least part of a pumping chamber, the pumping chamber contracting and expanding as the plunger reciprocates;

(d) means for allowing fuel to move into the pumping chamber as the pumping chamber expands in a fuel intake stroke;

(e) means for allowing the fuel to move out of the pumping chamber as the pumping chamber contracts in a fuel compression stroke; and (f) means for resisting movement of the plunger in at least part of the fuel compression stroke and relieving resistance to movement of the plunger in the fuel intake stroke wherein the resisting means comprises a seat member fixed to the plunger, and damper means for engaging the seat member to resist movement of the plunger in the fuel compression stroke and separating from the seat member to allow substantially free movement of the plunger in the fuel intake stroke.

4. A fuel injection pump comprising:

(a) engageable first and second cam members, the first cam member reciprocating axially as the first cam member moves angularly relative to the second cam member in cases where the first and second cam members are in engagement;

(b) means for urging the first cam member toward the second cam member to engage the first and second cam members;

(c) a plunger connected to the first cam member for reciprocation with the first cam member, the plunger defining at least part of a pumping chamber, the pumping chamber contracting and expanding as the plunger reciprocates;

(d) means for allowing fuel to move into the pumping chamber as the pumping chamber expands in a fuel intake stroke;

(e) means for allowing the fuel to move out of the pumping chamber as the pumping chamber contracts in a fuel compression stroke; and (f) means separate from the urging means and said plunger for generating a force, for resisting movement of the plunger by compressing a quantity of fuel in at least part of the fuel compression stroke.

5. A fuel injection pump for use with an internal combustion engine, comprising:

(a) a plurality of cam rollers;

(b) a cam disc placed in the fuel injection pump for rotation in synchronism with engine rotation, the cam disc having a cam surface formed with a plurality of cam protrusions;

(c) means for providing a resilient force to bring the cam surface in engagement with the cam rollers;

(d) a pumping plunger connected to the cam disc for rotation and reciprocation within a fixed sleeve member with movement of the cam disc, the pumping plunger moving in a first direction in a fuel intake stroke, the pumping plunger moving in a second direction opposite to the first direction against the resilient force in a fuel compression stroke during which fuel is injected to the engine; and (e) dampening means coaxial with said means for applying said resilient force, operable only after the pumping plunger moves a predetermined distance in the fuel compression stroke to generate a force resisting the movement of the pumping plunger in the second direction, the damping means relieving the resisting force for free movement of the pumping plunger in the first direction under the resilient force over the full range of the fuel intake stroke of the pumping plunger.

6. A fuel injection pump for use with an internal combustion engine, comprising:

(a) a plurality of cam rollers;

(b) a cam disc placed in the fuel injection pump for rotation in synchronism with engine rotation, the cam disc having a cam surface formed with a plurality of cam protrusions, the cam disc being urged under a resilient force to bring the cam surface in engagement with the cam rollers;

(c) a pumping plunger connected to the cam disc for rotation and reciprocation within a fixed sleeve member with movement of the cam disc, the pumping plunger moving in a first direction in a fuel intake stroke, the pumping plunger moving in a second direction opposite to the first direction against the resilient force in a fuel compression stroke during which fuel is injected to the engine; and (d) damping means operable only after the pumping plunger moves a predetermined distance in the fuel compression stroke to generate a force resisting the movement of the pumping plunger in the second direction, the damping means relieving the resisting force for free movement of the pumping plunger in the first direction under the resilient force over the full range of the fuel intake stroke of the pumping plunger, and wherein the pumping plunger has a small-diameter portion and a large-diameter portion having a shoulder facing in the second direction.

7. A fuel injection pump for use with an internal combustion engine, comprising:

(a) a plurality of cam rollers;

(b) a cam disc placed in the fuel injection pump for rotation in synchronism with engine rotation, the cam disc having a cam surface formed with a plurality of cam protrusions, the cam disc being urged under a resilient force to bring the cam surface in engagement with the cam rollers;

(c) a pumping plunger connected to the cam disc for rotation and reciprocation within a fixed sleeve member with movement of the cam disc, the pumping plunger moving in a first direction in a fuel intake stroke, the pumping plunger moving in a second direction opposite to the first direction against the resilient force in a fuel compression stroke during which fuel is injected to the engine; and (d) damping means operable only after the pumping plunger moves a predetermined distance in the fuel compression stroke to generate a force resisting the movement of the pumping plunger in the second direction, the damping means relieving the resisting force for free movement of the pumping plunger in the first direction under the resilient force over the full range of the fuel intake stroke of the pumping plunger wherein the damping means includes a first seat fixed on the pumping plunger, a second seat fixed in the fuel injection pump, and at least two dampers arranged in parallel with the direction of movement of the pumping plunger, each of the dampers being fixed at a respective first end to the second seat, each of the dampers having a respective second end separated the predetermined distance away from the first seat, each of the dampers generating a portion of the resisting force when pushed.

8. The fuel injection pump of claim 1, wherein:

the spring is a conical annular spring supported solely by the plunger.

9. The fuel injection pump of claim 3 wherein:

the damper means is aligned with the urging means for synchronization of their combined forces on the plunger.

10. The fuel injection pump of claim 6, wherein the damping means includes a bore formed in the sleeve member, a piston mounted for sliding movement on the pumping plunger small-diameter portion, a seat fixed on the pumping plunger small-diameter portion, and a resilient member seated between the seat and the piston for urging the piston in the first direction against the shoulder, the piston entering the bore to define a pressure chamber communicating with a fuel reservoir through a small clearance defined around the piston after the pumping plunger moves the predetermined distance in the fuel compression stroke, the pressure chamber having a volume decreasing to increase the pressure in the pressure chamber as the piston moves in the second direction within the bore.

11. The fuel injection pump of claim 10, wherein the piston is formed with at least one passage extending therethrough to enable communication between the pressure chamber and the fuel reservoir in the fuel intake stroke of the pumping plunger.

12. The fuel injection pump of claim 6, wherein the damping means includes a bore formed in the sleeve member, the pumping plunger large-diameter portion entering the bore to define a pressure chamber communicating with a fuel reservoir through a small clearance defined around the piston after the pumping plunger moves the predetermined distance in the fuel compression stroke, the pressure chamber having a volume decreasing to provide the resisting force as the pumping plunger large-diameter portion moves in the second direction within the bore, a passage communicating the pressure chamber with the fuel reservoir, and valve means provided in the passage, the valve means permitting flow only from the fuel reservoir to the pressure chamber.

13. The fuel injection pump of claim 7, wherein a portion of the resilient force is generated by at least two coil springs provided between the first and second seats.

14. The fuel injection pump of claim 13, wherein the dampers are placed in the respective coil springs.

* * * * *